United States Patent [19]

Varga et al.

[11] Patent Number: 4,511,158

[45] Date of Patent: Apr. 16, 1985

[54] INTRAVENOUS INFUSION POLE ATTACHMENT

[75] Inventors: Sandor I. Varga, Miami; Richard L. Dougherty, Miami Beach; Donny C. Dandy, Miami; Willie J. Thomas, Carol City, all of Fla.

[73] Assignee: Mt. Sinai Medical Center of Greater Miami, Miami Beach, Fla.

[21] Appl. No.: 412,195

[22] Filed: Aug. 27, 1982

[51] Int. Cl.[3] ..... A61G 1/02

[52] U.S. Cl. ..... 280/292; 5/60; 5/285; 5/508; 248/229; 269/322; 280/289 WC; 297/188; 297/DIG. 4; D24/52

[58] Field of Search ..... 280/289 WC, 289 R, 289 A, 280/292; 297/188, 192, 194, DIG. 4; 248/125, 229, 539; 403/188, 323, 324; 269/322; 5/60, 84, 285, 508, 512; D24/52

[56] References Cited

U.S. PATENT DOCUMENTS

| | | | |
|---|---|---|---|
| 1,806,773 | 5/1931 | Waters | 5/508 |
| 3,709,556 | 1/1973 | Allard et al. | 297/188 |
| 3,899,149 | 8/1975 | Schneider | 5/508 |
| 3,902,817 | 9/1975 | Meir | 403/188 |
| 4,113,222 | 9/1978 | Frinzel | 248/125 |
| 4,225,104 | 9/1980 | Larson | 248/125 |
| 4,305,601 | 12/1981 | Berge | 280/289 WC |

FOREIGN PATENT DOCUMENTS

| | | | |
|---|---|---|---|
| 533240 | 11/1954 | Belgium | 5/508 |

*Primary Examiner*—Joseph F. Peters, Jr.
*Assistant Examiner*—Kenneth R. Rice
*Attorney, Agent, or Firm*—Cushman, Darby & Cushman

[57] ABSTRACT

A device for securely yet removably attaching a pole, for example, an intravenous pole of the type having wheels supporting it for movement across a surface, to a wheeled patient transport device, such as, a wheeled stretcher, wheelchair, or the like, so that the pole and the patient transport device can be moved as a contiguous unit across a surface, the device comprises a clamp member for removably clamping the intravenous pole and a member rigidly associated with a portion of the patient transport device for receiving the clamp thereby securing the intravenous pole thereto.

13 Claims, 4 Drawing Figures

INTRAVENOUS INFUSION POLE ATTACHMENT

BACKGROUND AND SUMMARY OF THE INVENTION

The present invention generally relates to a novel device suitable for attaching an intravenous infusion pole (hereinafter "I.V. pole") of the type having wheels supporting the I.V. pole for movement across a surface, such as, the floor of a hospital, to a wheeled patient transport device, such as, a wheeled stretcher or a wheelchair so that the patient transport device and the I.V. pole can be moved as a contiguous unit across the floor.

I.V. poles without wheels have, in the past, been most commonly associated with hospital beds on which clamps have been provided so as to support the intravenous medication. Generally, an I.V. pole is of sufficient axial length so that intravenous medication can be elevated with respect to the patient receiving the treatment. In such a manner, gravity aides in the direct intravenous infusion of the medication into the patient.

In recent years intravenous infusion pumps have become widely used for patients receiving intravenous medication and such pumps now represent the state of the art for administering intravenous medication. Intravenous pumps, however, can weigh between 30 to 40 pounds and are, therefore, mounted on I.V. poles which have wheels for mobility across the floor of the hospital. It, of course, becomes necessary to move the infusion pump without detaching the pump from the I.V. pole when transporting a patient who is receiving intravenous therapy via an intravenous infusion pump. If the pump is removed from the I.V. pole, there is a danger of dropping or otherwise damaging an expensive and highly accurate piece of equipment. Moreover, another I.V. pole may not be available when the patient arrives at his or her destination. Accordingly, most intravenous pumps are rigidly secured to an independently mobile I.V. pole. Accordingly, the I.V. pole and the patient transport device must be concurrently moved when the patient is transferred or otherwise moved to a different location in the hospital.

It has been recognized that the proper procedure for moving a patient undergoing intravenous treatment via an intravenous infusion pump is to utilize two Hospital attendants. That is, one attendant is preferably utilized to push or otherwise assist in the movement of the patient on the patient transport device while the other attendant assists in moving the I.V. pole concurrently with the patient transport device so as to prevent or minimize the possibility of the patient being disconnected from the intravenous pump. However, as the reader will appreciate, utilizing two attendants each time a patient who is undergoing intravenous therapy needs to be moved is, of course, costly to the hospital. Moreover, two attendants are sometimes not available.

When two attendants are unavailable, the burden of moving the patient and the wheeled I.V. pole carrying the intraveneous pump, of course, falls upon one attendant. This procedure is less than desireable since movement of both the patient via the patient transport device and the intravenous pump via the wheeled I.V. pole is extremely unwieldly.

In practice, hospital attendants when faced with such a prospect have endeavored to tie or otherwise unite the wheeled I.V. pole to the patient transport device. Thus, it has been found that hospital attendants will tape the I.V. pole to the patient transport device. Additionally, it has been found that attendants will tie the I.V. pole to the patient transport device utilizing a length of electrical cord associated with the intravenous pump. In each instance, it is attempted to secure the I.V. pole to the patient transport device yet, as the reader may appreciate, such procedures are not adequate.

It is with the above problems in mind that the present invention was developed. According to the present invention, there is provided a secure device which couples the wheeled I.V. pole having the intravenous infusion pump thereon to a wheeled patient transport device. The term "wheeled stretcher" will be utilized hereinafter to refer to a wheeled patient transport device for which the present invention is particularly suited. However, those in the art will appreciate that other wheeled patient transport devices, such as, a wheelchair, or the like, are also suitable for use in combination with the present invention.

According to the present invention, therefore, there is provided a coupling device which securely couples the rolling I.V. pole to a wheeled stretcher so that only one attendant is required to properly move a patient from one location to another in the hospital. The device according to the present invention may be disengaged quickly in the event of an emergency situation and can be conveniently stored under the patient transport device as will be explained in more detail below.

It is entirely foreseeable that an intravenous infusion pump will eventually be utilized for all patients receiving intravenous therapy since the intravenous pump represents the the state of the medical art for intravenous therapy. It is also foreseeable that other types of similarly mounted medical support equipment e.g. that type of support equipment which is fairly heavy and, therefore, needs independent mobility, will be used and transported with patients more frequently. Accordingly, the need for the device of the present invention will, in all probability, substantially increase over the need that is already readily apparent. Therefore, the present device represents a distinct advance in the art in that state of the art medical support equipment can be securely, yet removably, attached to a patient transport device so that they can be moved as a unit with the patient.

In addition to the above advantages the present invention may also be quickly and efficiently provided on all existing patient transport devices without destroying the integrity thereof. The device according to the present invention can also be provided as a standard integral feature on all new patient transport devices which may hereinafter be produced.

These and other advantages will become more clear after careful consideration is given to the detailed description of the preferred exemplary embodiments which follows.

DETAILED DESCRIPTION OF THE PREFERRED EXEMPLARY EMBODIMENTS

Figures 1, 2:
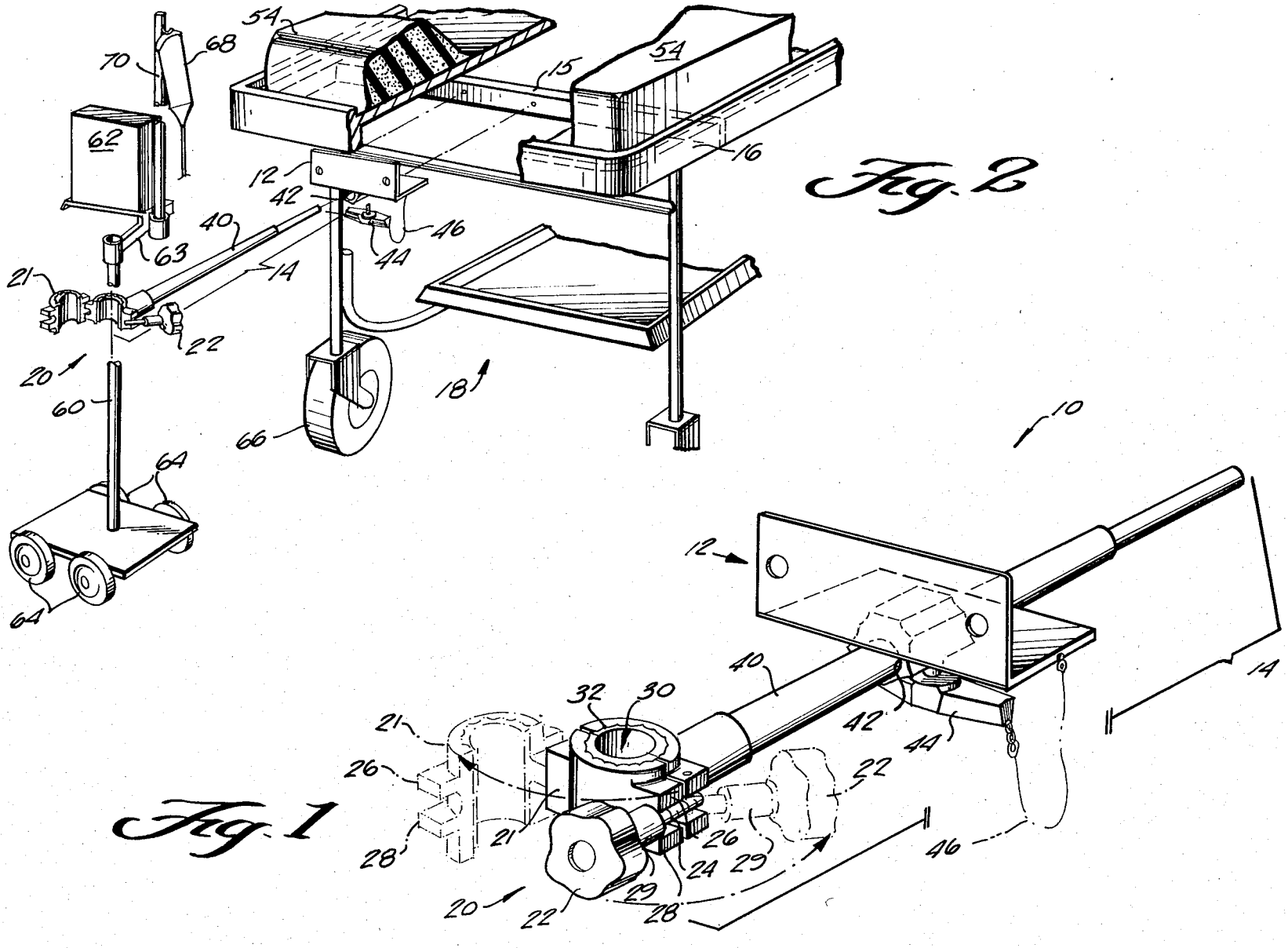
FIG. 1 is a close perspective view of an embodiment of the coupling device according to the present invention.
FIG. 2 is a perspective disassembled view of the coupling device of FIG. 1 in combination with a wheeled stretcher.

One embodiment of the coupling device 10 according to the present invention can be seen more clearly by referring to FIG. 1 wherein it is depicted as generally comprising two major component parts, a bracket 12 and a clamping member 14. Bracket 12 is suitable for being rigidly secured to a predetermined portion of cross support member 15 associated with the frame 16 of the wheeled stretcher 18 (see FIG. 2) by suitable means, such as, welding, threaded nuts and bolts, or the like. Clamping member 14 preferably includes a traction clamp 20 which, in and of itself, is well known in the art. A suitable traction clamp 20 which can be advantageously utilized according to the present invention is that type provided by Zimcode Traction Components, Catalog No. 1044-06. Of course, other clamps may be advantageously utilized as the need dictates.

Preferably, traction clamp 20 is such that at least one half 21 thereof is pivotable through an angle of at least 90°. Also, knurled knob 22 which threadably cooperates with a pivotable threaded member 24 is preferably provided so as to securely lock traction clamp 20 in a clamping position (noted in solid line in FIG. 1). Flange members 26,28 are disposed integral with pivotable half 21 and defines a space therebetween through which threaded member 24 can pass. Thus, when knurled knob 22 is turned clockwise (e.g. if right hand threads are provided on threaded member 24), collar 29 will bear against flanges 26,28 so as to lock pivotable half 21. Of course, upon opposite turning movement of knurled knob 22, disengagement of pivotable half 21 is effected by pivoting knob 22 away from flanges 26,28 as noted in phantom line in FIG. 1. Thereafter, pivotable half 21 may then be moved to an open position (phantom line in FIG. 1) to gain access to cavity 30.

In order to effect secure clamping engagement with the I.V. pole, cavity 30 should be lined with a suitable resilient lining material 32, e.g. leather, rubber, or the like.

Rigidly associated with traction clamp 20 is a rod member 40 which is slidably received in aperture 42 defined in bracket 12. Operatively associated with cavity 42, there is preferably provided locking means, such as, set screw 44 which, when tightened, bears against a portion of rod 40 in cavity 42 so as to lock rod 40 and, therefore, traction clamp 20 securely in a desired position e.g. extended or retracted positions. Safety chain 46 may also be provided so that set screw 42 will not be misplaced during periods of nonuse.

The coupling device 10 according to the present invention can be seen more clearly in combination with a wheeled stretcher 18 by referring to FIG. 2. As shown in FIG. 2, wheeled stretcher 18 generally comprises a metal frame 16 and a cushioned portion 54 on which a patient can be placed. I.V. pole 60 having an intravenous infusion pump 62 securely mounted thereto via support bracket 63 also includes wheels 64 which support it for movement across the floor. In a similar manner, stretcher 18 also includes wheels 66 (only one shown in FIG. 2 for clarity of presentation) which support it for movement across the floor. The container 68 for intravenous medication or the like is retained in an elevated position above pump 62 by I.V. extension pole 70. Connections between container 68, pump 62 and the patient have not been shown in the accompanying drawings as they form no part of the novel coupling device according to the present invention.

Bracket 12, as noted above, is preferably rigidly secured to cross support member 15 of frame 16. Bracket 12 should be mounted on either the fore or aft portions of frame 16 so that hospital doorways, passageways, etcetera, can be easily negotiated. However, if desired, bracket 12 can be mounted to the side portions of frame 16.

To place device 10 in an operative position, an attendant need only slidably extend rod 40 in aperture 42 until traction clamp 20 is a desired dimension from frame 16. Clamp 20 is then operated so that I.V. pole 60 is received in cavity 30 (FIG. 1) and, thereafter, knurled knob 22 is turned to effect rigid union between I.V. pole 60 and stretcher 18.

In order to store device 10 during periods of non-use rod 40 need only be slidably retracted in aperture 42 in a manner opposite to that described above so that device 10 is positioned under stretcher 18 and does not extend beyond frame 16. Since cross support member 15 is displaced interiorly of frame 16, when rod 40 is in a retracted position, clamp 20 will be substantially "hidden", e.g. will not extend beyond the periphery of frame 16. However, when it is desired to put the I.V. post clamp into use, an attendant need only loosen set screw 44, and extend rod 40, so that clamp 20 extends a predetermined distance beyond frame 16. Clamp 20 can then be securely coupled to I.V. pole 60 and, as such, a complete rigid union is effected between the stretcher 18 and wheeled I.V. pole 60.

Of course, bracket 12 may be rigidly coupled to the peripheral edge of frame 16 but, as described, such a placement would not be as advantageous since clamp 20 could not be "hidden" in a retracted position.

The embodiment of the present invention depicted in FIGS. 1 and 2 is especially suitable for providing existing wheeled stretchers with the capability of coupling wheeled I.V. poles thereto, e.g. "retro-fitting" existing wheeled stretchers. However, in FIGS. 3 and 4, there are shown other embodiments of the present invention which are suitable for being incorporated with the wheeled stretcher so as to provide integral I.V. pole coupling capability.

Figure 3:
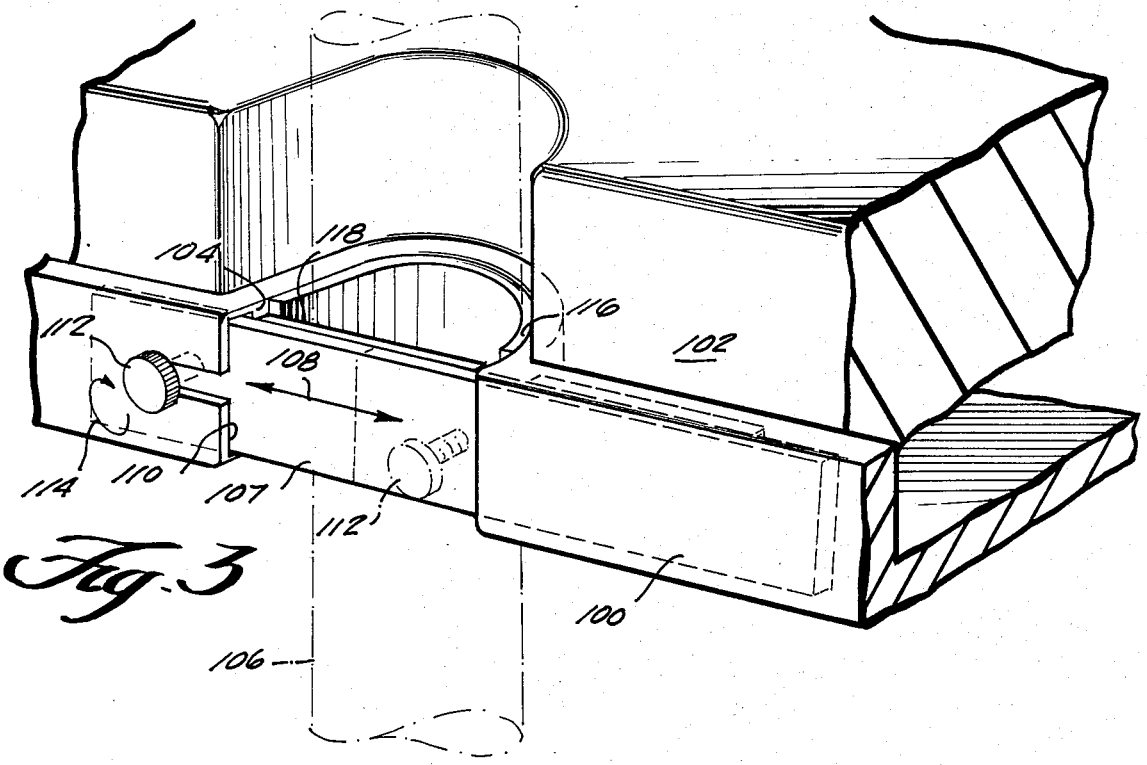
FIG. 3 is a close perspective view of another embodiment of the coupling device according to the present invention.

One such integral coupling embodiment is depicted in FIG. 3. Frame 100 of the wheeled stretcher (not shown entirely in FIG. 3 or 4 for clarity of presentation) normally supports cushion 102 on which the patient is placed. Frame 100 preferably defines a recessed space 104 dimensioned so as to accept a portion of I.V. pole 106 therein. Integral with frame 100 there is provided a locking bar 107 which is slidably received in a portion of frame 100 so as to be capable of being reciprocably moved (arrow 108) between a locked position (noted in solid line in FIG. 3) and an open position (noted in phantom line in FIG. 3).

A portion of bar 107 is slidably received in recess 110 formed in frame 100 so that in a closed position, bar 107 will extend across space 104 so as to restrain I.V. pole 106 therein. Knob 112 is threadably associated with bar 107 and can be turned (arrow 114) so as to bear against frame 100 to lock I.V. pole 106 in space 104. To remove I.V. pole 106 from space 104, one need only turn knob 112 in a direction opposite to arrow 114 and slidably move bar 107 to its open position. In such a manner, I.V. pole 106 can be removed from space 104 in a quick and, efficient manner. Of course, to couple I.V. pole 106 to frame 100, the reverse operation is utilized.

In order to reduce noise associated with metal to metal contact, resilient linings 116,118 of, for example, sponge rubber, leather, or the like, are preferably provided in space 104 and the interior portion of bar 107, respectively.

Figure 4:
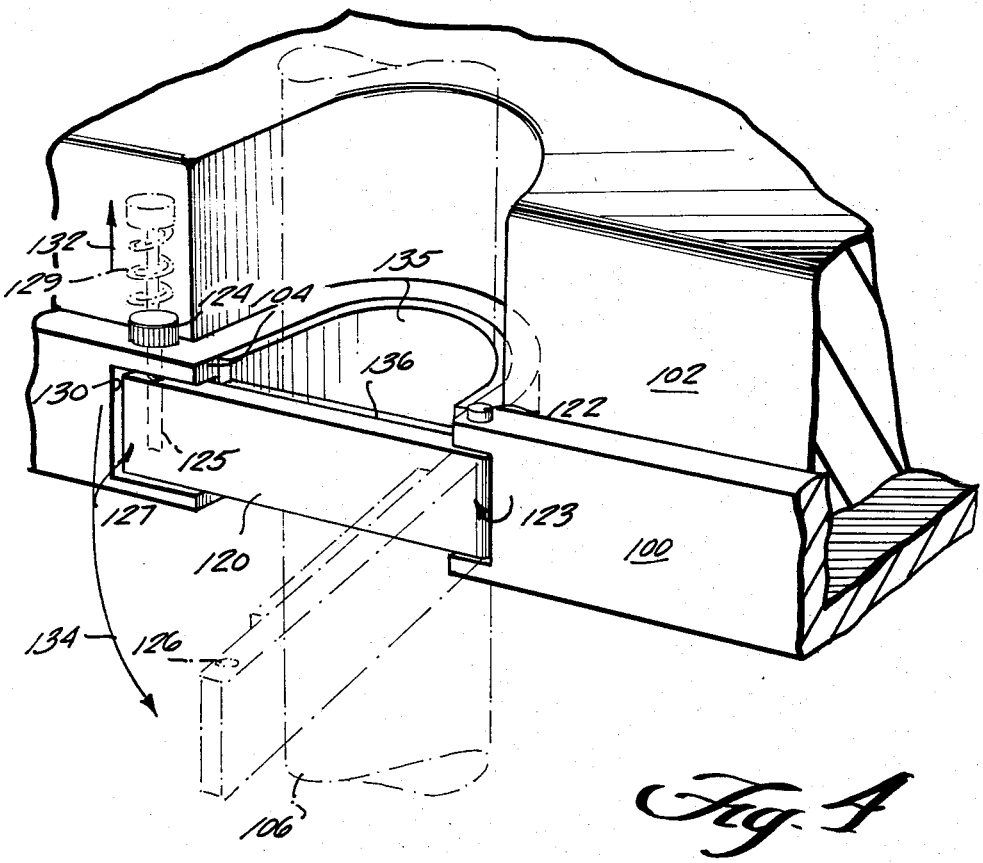
FIG. 4 is a close perspective view of yet another embodiment of the coupling device according to the present invention.

The embodiment of FIG. 4 is similar to the embodiment described above regarding FIG. 3 in that frame 100 defines a space 104 into which I.V. pole 106 can be accepted. However, according to the embodiment of FIG. 4, locking bar 120 is mounted to frame 100 at one end 123 via pivot pin 122. Knob 124 having locking pin 125 is provided so as to cooperate with aperture 126 formed in the other end 127 of bar 120. Spring 129 is operatively associated with knob 124 and pin 125 so as to bias them in a downward or locked position. Recess 130 is provided in frame 100 opposite pivot pin 122 as to to accommodate end 127 therein.

Thus, bar 120 can be pivotably moved (arrow 134) between a locked position (noted in solid line in FIG. 4) and an open position (noted in phantom line in FIG. 4). Preferably, bar 120 is pivotable through an angle of at least 90°. While in the open position, I.V. pole 106 can be moved into space 104 and thereafter bar 120 can be moved to its closed position. Of course, knob 124 must be raised (arrow 132) so that stem 125 will not obstruct the acceptance of bar 120 into recess 130. Once bar 120 is properly seated in recess 130, release of knob 124 will cause stem 125 to penetrate aperture 126 due to the downward bias provided by spring 129 so as to lock pole 106 securely in place.

Resilient linings 135, 136 are provided in the embodiment of FIG. 4 for purposes similar to linings 116,118 described above with regard to the embodiment of FIG. 3.

While reference has been herein made to a wheeled stretcher, those in the art, will, of course, appreciate that other wheeled patient transport devices are also particularly suitable for use in combination with the present invention, such as, for example, a wheelchair, or the like. Thus, while the above invention has been described as suitable for use in combination with a wheeled stretcher, those in the art should realize that this merely represents a preferred embodiment according the present invention and is, therefore, non-limiting thereto.

The coupling device according to the present invention therefore avoids potential risk to the patient such as preventing dislodging of the intravenous cannula which reduces the incidence of infiltration. The I.V. pole by necessity extends a substantial distance above the patient and, therefore, can be fairly unstable and susceptible to small variations in the surface which may cause the I.V. pole to fall during independent transportation across the floor. However, the coupling device of the present invention provides a means for rigidly securing the I.V. pole during transportation so as prevent the pole and the heavy intravenous pump from falling upon the patient.

The coupling device of the present invention is also particularly beneficial to patients in wheelchairs since it permits increased mobility of the patients by allowing more freedom to assist themselves with activities of daily living without requiring the aid of a hospital attendant which otherwise would be necessary to assist in moving the I.V. pole.

Thus, while the present invention has been herein described in what is presently conceived to be the most preferred embodiments thereof, those in the art will appreciate that many modifications may be made hereof, which modifications shall be accorded the broadest scope of the appended claims so as to encompass all equivalent assemblies, structures and devices.

What is claimed:

1. A wheeled patient transport device adapted to having a vertically elongated pole removably attached thereto comprising in combination:

an outer frame defining a frame periphery, said frame having at least one support member interiorly disposed relative to said frame periphery;

a bracket rigidly fixed to said support member and defining an aperture therein;

an elongated male member slideably received in said aperture and including at one end clamping means for removably clamping said pole to said patient transport device so that said pole and said patient transport device are moveable as a contiguous unit when clamped one to another, wherein said bracket includes means permitting reciprocal movement of said male member between an extended position wherein said clamping means extends beyond the frame periphery to permit said clamping means to removably clamp said pole and a retracted position wherein said clamping means is retracted interiorly of the frame periphery so as to be substantially hidden.

2. A device for removeably attaching a pole of the type having wheels for supporting the pole for movement across a surface to a wheeled patient transport device of the type having a frame defining a frame periphery and having at least one support member interiorly disposed relative to the frame periphery so that the pole and patient transport device can be moved as a unit across the surface, said device comprising:

a bracket defining an aperture and adapted to being rigidly fixed to the support member;

an elongated male member received in said aperture and including at one end clamping means for removably clamping said pole to said patient transport device so that said pole and said patient transport device are moveable as a contiguous unit when clamped one to another, wherein said bracket includes means permitting reciprocal movement of said male member between an extended position wherein said clamping means extends beyond the frame periphery to permit said clamping means to removably clamp said pole and a retracted position wherein said clamping means is retracted interiorly of the frame periphery so as to be substantially hidden.

3. A device as in claim 1 or 2 wherein said clamping means further includes:

a clamp member fixedly connected to said male member and having first and second clamp portions pivotally attached to one another and defining therebetween a clamping cavity, said first clamp portion being pivotal between closed and open positions relative said second clamp portion; and means for removeably retaining said first clamp member in said closed position.

4. A device as in claim 1 or 2 wherein said male member is an elongated rod.

5. A device as in claim 1 or 2 wherein said bracket further includes locking means operatively associated with said aperture for contacting a predetermined portion of said male member slidably received in said aperture to securely lock said male member in said extended or retracted positions.

6. A device for securely yet removeably attaching a pole of the type having wheels for supporting said pole for movement across a surface to a wheeled patient transport device having a frame such as, a wheeled stretcher, wheelchair or the like, so that said pole and said patient transport device can be moved as a unit across said surface, said device comprising clamping means for removeably clamping said pole to said patient transport device, said clamping means including a space defined by said frame and having an open end for accepting a portion of said pole therein; and locking means for securely yet removeably locking said pole in said space.

7. A device as in claim 6 wherein said locking means comprises:

a bar extending across said open end; and means for mounting said bar to said frame for pivotable movement between open and closed positions.

8. A device as in claim 7 wherein said locking means includes:

an aperture defined by said bar opposite said mounting means;

pin means associated with said frame for lockable engagement with said aperture; and biasing means for biasing said pin means into said lockable engagement.

9. A device as in claim 6 wherein said locking means comprises:

a bar extending across said open end; and means for mounting said bar to said frame for reciprocal movement between open and closed positions.

10. A device as in claim 9 wherein said bar includes knob means threadably engaged to said bar for removeably locking said bar to said frame in said closed position so that predetermined turning movement of said knob will effect locking engagement with a portion of said frame by virtue of said threaded engagement of said knob to said bar.

11. A wheeled patient device transport device adapted to having an elongated pole removably attached thereto, said patient transport device comprising:

a frame for supporting a patient and having a portion defining an open ended space to receive part of the pole therein;

plural wheels journally mounted to said frame to permit rolling movement thereof across a surface; and clamping means operatively connected to said frame at said space defining portion for removably clamping said pole in said space wherein said clamping means includes a bar extending across said open ended space; and mounting means for mounting said bar to said frame to permit reciprocal rectilinear sliding movement of said bar between open and closed positions.

12. A patient transport device as in claim 11 wherein said bar includes knob means threadably engaged to said bar for removably locking said bar in said closed position so that predetermined turning movement of said knob will effect locking engagement with a portion of said frame by virtue of said threaded engagement of said knob to said bar.

13. A wheeled patient transport device adapted to having an elongated pole removably attached thereto, said patient transport device comprising:

a frame for supporting a patient and having a portion defining an open ended space to receive part of the pole therein;

plural wheels journally mounted to said frame to permit rolling movement thereof across a surface; and clamping means operatively connected to said frame at said space defining portion for removably clamping said pole in said space, said clamping means including (a) a bar extending across said open ended space;

(b) mounting means for mounting said bar to said frame to permit pivotal movement thereof between open and closed positions;

(c) an aperture defined by said bar opposite said mounting means;

(d) pin means for removably locking said bar in said closed position and mounted to said frame for movement between a locked position wherein said pin means in disposed in said aperture and an unlocked position wherein said pin means is clear of said aperture; and (e) biasing means connected to said pin means for biasing said pin means into said locked position.

* * * * *